US005520338A

United States Patent [19]

Lohmann

[11] Patent Number: 5,520,338

[45] Date of Patent: May 28, 1996

[54] FUEL INJECTOR NEEDLE CHECK VALVE BIASING SPRING

[75] Inventor: Craig W. Lohmann, Denver, Iowa

[73] Assignee: Caterpillar Inc., Peoria, Ill.

[21] Appl. No.: 309,709

[22] Filed: Sep. 21, 1994

[51] Int. Cl.[6] ..... F02M 61/20

[52] U.S. Cl. ..... 239/533.9

[58] Field of Search ..... 239/533.2–533.12; 137/509, 535, 529; 267/158, 164, 165

[56] References Cited

U.S. PATENT DOCUMENTS

| | | | |
|---|---|---|---|
| 1,690,893 | 11/1928 | Dorner | 239/533.9 |
| 2,214,459 | 9/1940 | Gottlieb | 137/535 |
| 2,406,746 | 9/1946 | David | 267/164 |
| 3,131,709 | 5/1964 | Richards | 137/202 |
| 3,175,771 | 3/1965 | Breting | 239/533.9 |
| 3,301,492 | 1/1967 | Kingsley | 239/533.9 |
| 3,627,209 | 12/1971 | Scott | 239/533.9 |
| 4,156,391 | 5/1979 | Ubezio | 267/165 |
| 5,183,209 | 2/1993 | Ricco et al. | 239/585.1 |

FOREIGN PATENT DOCUMENTS

| | | | |
|---|---|---|---|
| 1055227 | 2/1954 | France | 239/533.9 |
| 60787 | 2/1892 | Germany | 137/529 |
| 1055370 | 4/1959 | Germany | 137/529 |

*Primary Examiner*—Karen B. Merritt

*Attorney, Agent, or Firm*—Mark D. Becker; Liell & McNeil

[57] ABSTRACT

A pair of C-shaped springs adapted for biasing a needle check valve of a fuel injector toward a closed position. The springs are capable of providing a valve opening pressure several times larger than that provided by conventional helical springs, while occupying roughly the same amount of space as prior art biasing springs. Preferably, the individual C-shaped biasing springs include semi-circular indentations in their upper and lower end edges so that the biasing springs abut against each other and substantially surround the shaft of the needle stop for the check valve.

8 Claims, 2 Drawing Sheets

FUEL INJECTOR NEEDLE CHECK VALVE BIASING SPRING

TECHNICAL FIELD

The present invention relates generally to biasing springs for fuel injector check valves, and more particularly to a high valve opening pressure fuel injector needle check valve.

BACKGROUND ART

Current fuel injectors have valve opening pressures (VOP) for the needle check that are limited by the size of the coil spring capable of fitting within available space in the injector. In most fuel injection applications, higher valve opening pressures provide numerous benefits, including cleaner engine emissions, lower injector minimum delivery capability and more efficient combustion. The current state of the art in fuel injector needle check valves is to utilize a coil spring as the biasing element. Unfortunately, coil springs cannot always provide the sufficient biasing force in applications requiring a high valve opening pressures, and the option of using larger coil springs is not available due to space constraints. Some manufacturers have experimented with substituting stacks of belville washers in place of conventional coil biasing springs; however, the force constant of the belville stack is not reliably predictable and tends to change over time. What is needed is a biasing spring with a reliably predictable force constant that will fit in roughly the same volume of the current coil springs, yet provide a relatively large force constant, and perform predictable over a working life comparable to prior art coil springs.

DISCLOSURE OF THE INVENTION

In responding to this need, the present invention comprises an improved fuel injector needle check valve biasing spring. The spring comprises at least two substantially identical elongated pieces of metal formed generally into a C-shape to include a middle portion between a lower portion and an upper portion. The C-shape has a length, and the middle portion makes up a majority of this length. Each piece of metal includes an upper end planar surface and a lower end planar surface. Each pair of metal pieces contact one another along the planar surfaces.

BEST MODE FOR CARRYING OUT THE INVENTION

Figure 1:
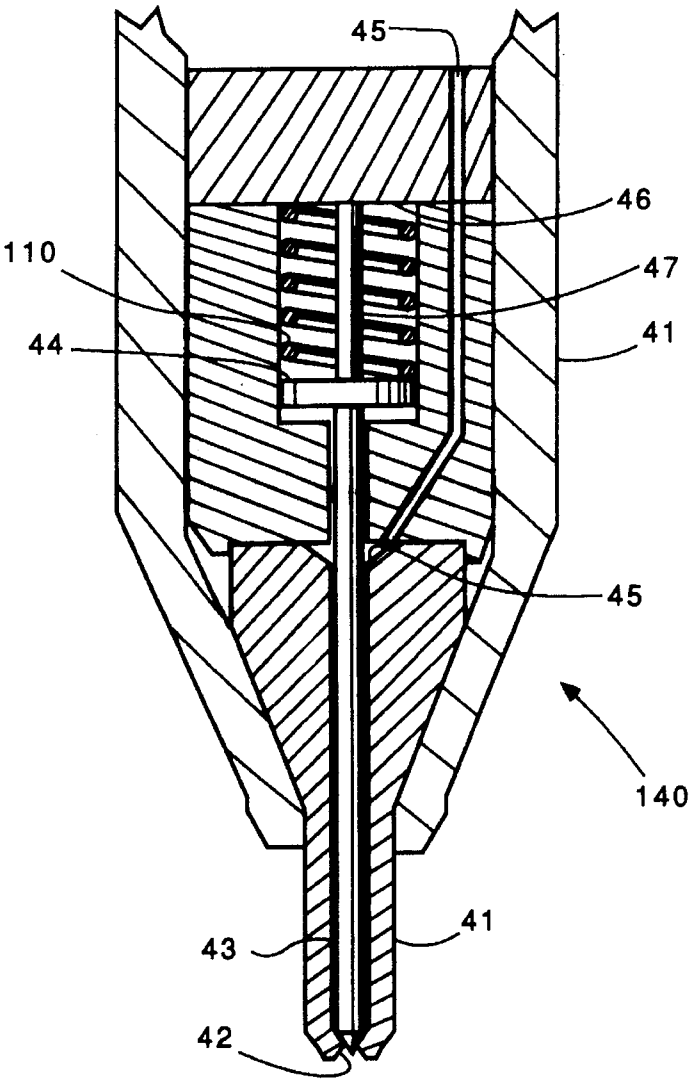
Figure 1 (Prior Art)
FIG. 1 is a sectioned partial front elevational view of a fuel injector needle check valve according to the prior art.
Figure 5:
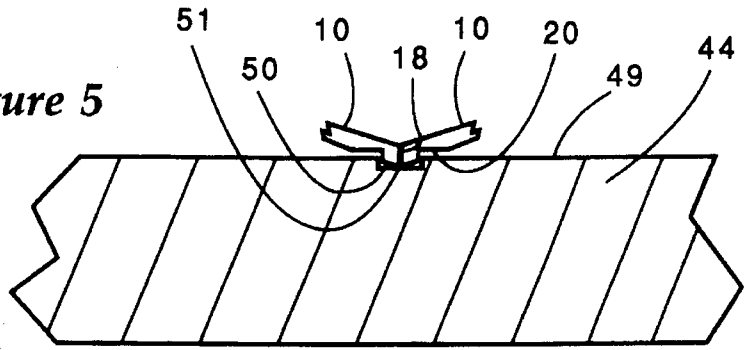
FIG. 5 is an enlarged side elevational view of one end of the biasing spring according to the present invention.

Referring now to FIG. 1, fuel injector needle check valves have long been known in the art. These fuel injectors include a valve body 41, which can include a plurality of individual components mated and/or attached to one another in one of several ways known in the art. A flow channel 45 extends through the valve body from an inlet supply opening to a nozzle 42. A needle plunger 43 is normally seated adjacent nozzle 42 to prevent fuel from escaping until the fuel pressure in flow channel 45 is sufficient to displace platform 44 against the action of coil biasing spring 110. Needle stop 47 limits the movement of needle plunger 43 when it strikes against the bottom face in a bore (not shown) in platform 44 in a manner known in the art. The other end of needle stop 47 is embedded in upper spring stop 46. Referring now to FIG. 5, a pair of C-shaped biasing spring elements 10 are shown in contact with upper surface 49 of platform 44 along a single line 51. In the present invention platform 44 as well as upper spring stop 46 are machined to include a relatively small shallow channel 50 that receives the ends of the biasing springs. This insures that the biasing springs do not migrate or otherwise move laterally during operation of the injector. In addition to the ends of the biasing springs being machined to provide a planer surface 18, a relatively small notch 20 is also machined in order to provide clearance between the spring elements and the platform 44 and upper spring stop 46. Thus in the preferred embodiment the typical injector is modified not only by the inclusion of the C-shaped biasing spring elements according to the present invention but also by machining a channel 50 in the spring platform as well as in the upper spring stop 46 in order to prevent lateral migration of the spring elements from their desired positions. The combination of space restrictions and the demands for higher valve opening pressures has pushed the current state of the art toward a compact substitute for the coil biasing springs of the prior art.

Figure 2:
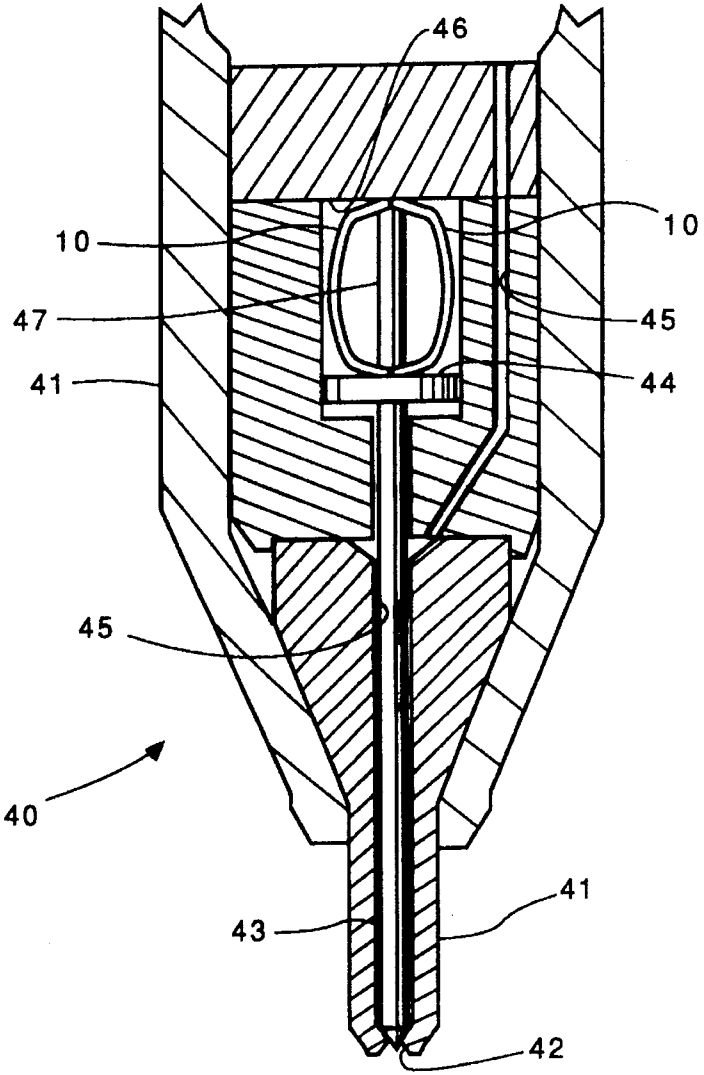
FIG. 2 is a sectioned partial front elevational view of a fuel injector needle check valve according to the preferred embodiment of the present invention.

FIG. 2 shows a fuel injector needle check valve 40 which is substantially identical to the check valve previously described except that C-shaped biasing springs 10 have been substituted in the place of the coil biasing spring 110 of the prior art. All other elements of the valve are substantially identical (except see FIG. 5, and accompanying text) to that of the prior art check valve and are identically numbered. In this case, a pair of C-shaped biasing springs 10 are positioned in opposition to one another around a portion of the upper shaft of needle plunger 43. Biasing springs 10 are substantially identical to each other and are formed into a C-shape from individual elongated pieces of metal.

The spring action is created by the flexibility or bowing of the middle portion. In other words, when in action, the end portions of the biasing springs displace toward one another as the middle portion bows outward which allows the needle plunger to become unseated to allow fuel to escape through nozzle 42. It has been found that by utilizing elongated pieces of metal made from spring steel and formed substantially as shown provide significantly higher valve opening pressures than conventional coil springs, while providing an adequate working life, even after numerous cycles of high frequency opening and closing. Furthermore, when the biasing springs are cut and formed from an elongated strip of spring steel having a uniform thickness and width, variance between the individual springs is minimized and the force constant of each spring becomes very predictable. Thus, the present invention can be manufactured in larger quantities at low cost with relatively close tolerances. Because the present invention permits a higher percentage of the spring's material to be stressed during deformation relative to that of a coil spring with equal size, the present invention can provide significantly higher spring constants, and valve opening pressures, than that possible with an equal sized coil spring. Although the present invention is significantly stiffer than coil springs of the prior art, it still permits sufficient deflection to perform satisfactorily in an injector needle check valve environment.

Figure 3:
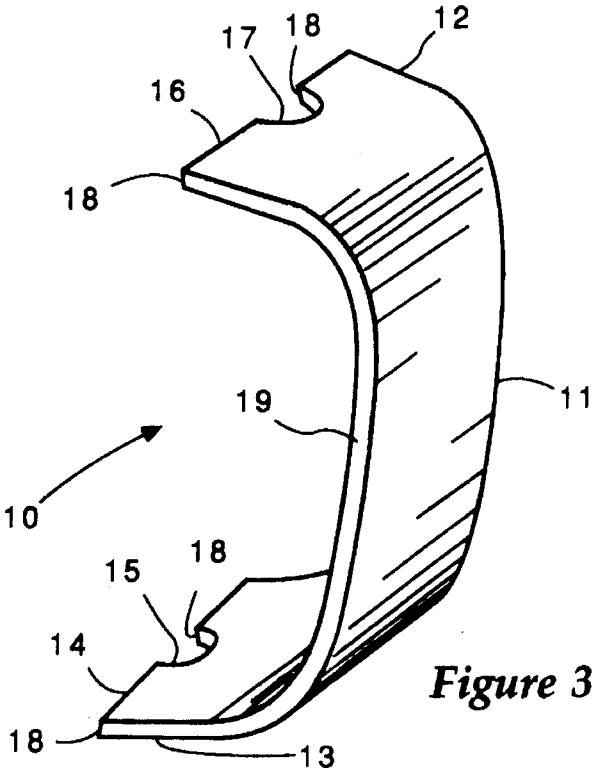
FIG. 3 is an enlarged isometric view of a biasing spring element according to the present invention.

Referring now to FIG. 3, an enlarged view of an individual biasing spring element 10 is illustrated. Spring 10 is formed from an elongated strip of spring steel in a conventional manner to include a middle portion 11 between a lower portion 13 and an upper portion 12. A majority of the spring's length is made up of the middle portion, where a majority of deformation occurs. However, it is important that the biasing springs 10 be mounted within the injector with sufficient clearance from the valve body wall 48 (FIG. 4) to avoid contact during deformation. This insures that the spring behaves linearly over its deflection range and also protects against unwanted side forces on the needle plunger. The upper portion includes an upper end 16 and an indentation 17 shaped to partially surround a portion of the upper shaft of the needle stop. In the preferred embodiment, two opposing biasing spring elements 10 are utilized and the indentation 17 is formed in a semi-circular shape in order to permit the upper end edge of the spring elements to abut each other along planar surface 18 as shown in FIG. 2. Likewise, lower portion 13 includes a lower end 14 that includes an indentation 15 sized to partially surround the needle stop shaft. Provided the needle stop shaft is substantially uniform in shape and diameter, indentation 15 will be substantially identical to indentation 17 in the upper end. The remaining portions of upper end 16 and lower end 14 are substantially flat planar surfaces 18 that are generally parallel to the walls surrounding the spring. Planar surfaces 18 are preferably machined onto biasing springs 10 after being formed into a C-shape. This shaping permits the opposing springs elements to have contact with one another along a planar surface instead of along a corner edge. In order to minimize manufacturing complexity and costs, each spring element 10 is preferably formed from elongated strips of metal having a substantially uniform thickness and width. In one specific example, biasing spring 10 is approximately ten millimeters wide, approximately one millimeter thick and approximately twenty millimeters in length after forming. Approximately sixteen millimeters of the twenty millimeter length are taken up by the middle portion, which bows outward when the spring undergoes deformation. In this way, most the material deformation occurs over the relatively long middle portion, rather than simply flexing at the corners separating the upper and lower portions from the middle portion.

Figure 4:
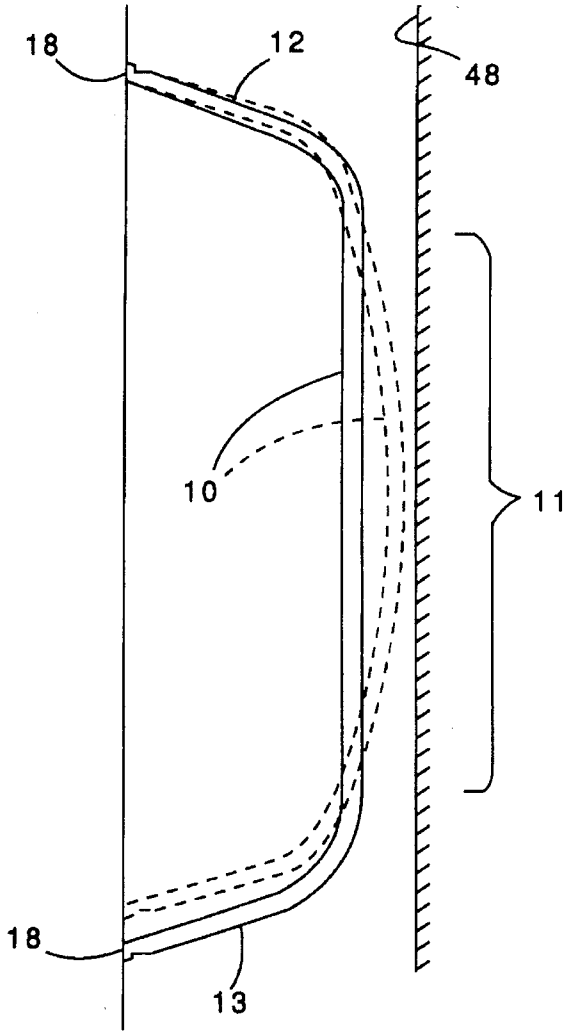
FIG. 4 is an enlarged side elevational view of a single biasing spring element according to the present invention.

Referring now to FIG. 4, an exaggerated deflection action of the biasing spring of the present invention is illustrated. As stated earlier, when undergoing deflection, the middle portion bows outward adjacent the retaining wall 48 of the valve body. It is important to note that each biasing spring contacts the upper spring stop 46 and platform 44 along a corner edge because the upper and lower portions point in divergent directions. This shaping tends to encourage deformation in the middle portion rather than at the bend separating the individual portions. It is also important to note that even while undergoing deformation, adjacent spring elements 10 maintain contact with one another over planar surfaces 18. It has been found that this structure utilizing two spring elements 10 has a working life comparable to that of spiral springs.

INDUSTRIAL APPLICABILITY

The present invention finds particular applicability in fuel injectors having constraints on the volume available within the injector for a biasing spring element. Even with the use of exotic metals, it is well known that there is a limit to the magnitude of a force constant available from a coil spring that must fit within a fixed volume. As stated earlier, higher spring constants are possible with the present invention since more of the spring undergoes deformation during a deflection than in a comparable coil spring. This permits the present invention to achieve relatively larger force constants. Those skilled in the art of biased check valves for various devices should immediately appreciate the applicability of the present invention in those instances having spring volume constraints, requiring a relatively small deflection distances and needing relatively larger spring force constants.

It should be clear that various modifications can be made to the present invention as herein above described and many apparently different embodiments of the same can be made or practiced within the spirit of the invention without departing from the scope of the attached claims. For example, in some applications it may be desirable to use three, four or more C-shaped spring elements arranged around a central plunger element. In such a case, the indentation in the upper and lower edges of the spring element would be only an arc of a circle, assuming that the plunger element was cylindrical in shape. In any event, multiple C-shaped spring elements may be desirable in those cases where side forces on the needle plunger shaft are a concern, or for any other reason known in the art. It is intended that the above description serve only to aid in an understanding of the invention and is not intended to limit the legal scope of the patent which is defined solely by the claims set forth below.

I claim:

1. A fuel injector needle check valve, including the elements of a valve body, a needle plunger, an upper spring stop, a needle stop, a spring platform, a flow channel, a nozzle and a biasing spring, wherein the improvement comprises:

said biasing spring being at least two substantially identical elongated pieces of metal formed generally into a C-shape to include a middle portion between a lower portion and an upper portion and arranged with one end in contact with the upper spring stop and the other end in contact with the spring platform, said upper portion has an upper end edge and said lower portion has a lower end edge, each said edge has an indentation sized to partially surround the needle stop of the check valve.

2. The improved fuel injector needle check valve of claim 1, wherein each said elongated piece of metal has a substantially uniform thickness.

3. The improved fuel injector needle check valve of claim 1, wherein said indentations are substantially semicircular.

4. The improved fuel injector needle check valve of claim 1, wherein said upper end edge of each said elongated piece of metal abuts said upper end edge of at least one other of said elongated pieces of metal.

5. The improved fuel injector needle check valve of claim 1, wherein said lower end edge of each said elongated piece of metal abuts said lower end edge of at least one other of said elongated pieces of metal.

6. The improved fuel injector needle check valve of claim 5, wherein said at least two substantially identical elongated pieces of metal is two substantially identical elongated pieces of metal.

7. The improved fuel injector needle check valve of claim 1, wherein said upper portion and said lower portion point in divergent directions.

8. The improved fuel injector needle check valve of claim 1, wherein the improvement further comprises a first channel formed in the upper spring stop and a second channel formed in the spring platform; said upper end edge is received in said first channel; and said lower end edge is received in said second channel.

* * * * *